US012017737B2

(12) United States Patent
Patterson et al.

(10) Patent No.: US 12,017,737 B2
(45) Date of Patent: Jun. 25, 2024

(54) PLATFORM FOR A SEA VESSEL

(71) Applicant: BOAT PORCH INC., Valencia, CA (US)

(72) Inventors: Geoff Patterson, Newhall, CA (US); Geremy Jack Patterson, Valencia, CA (US); Grant Leigh Nelson, Valencia, CA (US)

(73) Assignee: BOAT PORCH INC., Valencia, CA (US)

( * ) Notice: Subject to any disclaimer, the term of this patent is extended or adjusted under 35 U.S.C. 154(b) by 335 days.

(21) Appl. No.: 17/321,133

(22) Filed: May 14, 2021

(65) Prior Publication Data

US 2021/0354786 A1 Nov. 18, 2021

Related U.S. Application Data

(60) Provisional application No. 63/025,842, filed on May 15, 2020.

(51) Int. Cl.

| | |
|---|---|
| ***B63B 17/02*** | (2006.01) |
| ***B63B 17/00*** | (2006.01) |
| ***B63B 34/67*** | (2020.01) |

(52) U.S. Cl.

CPC ..... *B63B 17/02* (2013.01); *B63B 17/00* (2013.01); *B63B 34/67* (2020.02); *B63B 2017/026* (2013.01); *B63B 2221/08* (2013.01)

(58) Field of Classification Search

CPC ... B63B 17/00; B63B 17/02; B63B 2017/026; B63B 34/60; B63B 34/67; B63B 2221/08

See application file for complete search history.

(56) References Cited

U.S. PATENT DOCUMENTS

| | | | | |
|---|---|---|---|---|
| 4,194,459 | A * | 3/1980 | Lisowski | B63B 17/00 114/221 R |
| D329,838 | S * | 9/1992 | Dean | B63B 17/02 D8/381 |
| 5,743,208 | A * | 4/1998 | Miller | B63B 17/02 114/361 |
| 5,918,613 | A * | 7/1999 | Larson | B63B 17/02 135/141 |
| 6,637,364 | B1 * | 10/2003 | Campeau | B63B 17/02 114/361 |
| 7,401,569 | B2 * | 7/2008 | Jones | F16B 21/12 114/361 |
| 10,450,036 | B2 * | 10/2019 | Killian | B63B 17/02 |
| 10,723,414 | B1 * | 7/2020 | Small | B63B 17/02 |
| 10,843,775 | B2 * | 11/2020 | Todd | B63B 32/80 |

* cited by examiner

*Primary Examiner* — Ajay Vasudeva

(74) *Attorney, Agent, or Firm* — Lewis Roca Rothgerber Christie LLP

(57) ABSTRACT

A platform assembly configured to be coupled to a tower of a sea vessel. The platform assembly includes a platform, a series of brackets configured to be coupled to the platform, and a series of clamps configured to be coupled to the series of brackets. The series of clamps are configured to detachably couple the platform assembly to the tower of the sea vessel.

16 Claims, 7 Drawing Sheets

PLATFORM FOR A SEA VESSEL

CROSS-REFERENCE TO RELATED APPLICATION(S)

The present application claims priority to and the benefit of U.S. Provisional Application No. 63/025,842, filed May 15, 2020, the entire contents of which are incorporated herein by reference.

BACKGROUND

1. Field

The present application relates generally to a platform assembly configured to be attached to a tower of a sea vessel.

2. Description of Related Art

Sea vessels (e.g., powerboats) may be provided with a tower, such as a metal framework that is mounted to the hull of an inboard boat, that facilitates attachment of various accessories or auxiliary devices, such as speakers, lights, covers, shades (i.e., "biminis"), storage racks, or a tow point (e.g., an eye hook) for attachment of a tow line for a wakeboarder. However, such conventional accessories and auxiliary devices are typically custom-built to the specifications of the tower and the inboard boat and thus they cannot be detached and installed on other boat towers, which limits the versatility of these conventional boat accessories and auxiliary devices.

SUMMARY

The present disclosure relates to various embodiments of a platform assembly configured to be coupled to a tower of a sea vessel. In one embodiment, the platform assembly includes a platform, a series of brackets configured to be coupled to the platform, and a series of clamps configured to be coupled to the series of brackets. The series of clamps are configured to detachably couple the platform assembly to the tower of the sea vessel.

At least one clamp of the series of clamps may be a hinged clam-shell clamp including a first clam shell half and a second clam shell half hingedly coupled to the first clam shell half with a pin.

At least one bracket of the series of brackets may include a riser plate and a flange coupled to the riser plate. The flange defines at least one opening configured to receive a fastener securing the at least one bracket to the platform.

The riser plate may taper from a relatively wider upper end to a relatively narrower lower end.

The platform assembly may also include an adjustable coupler configured to couple one bracket of the series of brackets to one corresponding clamp of the series of clamps.

The adjustable coupler may include a main body portion defining a central opening, an outer tube having a first diameter extending into the central opening, an inner tube having a second diameter less than the first diameter extending into the central opening, a first fixture coupled to an end portion of the outer tube, and a second fixture coupled to an end portion of the inner tube. The inner tube is slidable within the central opening of the main body portion and within the outer tube to adjust an overall length of the adjustable coupler.

The central opening of the main body portion may include a first portion, a second portion having a larger diameter than the first portion, and a shoulder between the first portion and the second portion.

The main body portion may include a first opening extending into the first portion of the central opening, a first set screw in the first opening extending into the first portion of the central opening and configured to engage the inner tube, a second opening extending into the second portion of the central opening, and a second set screw in the second opening extending into the second portion of the central opening and configured to engage the outer tube.

One bracket of the series of brackets may be configured to be directly coupled to one corresponding clamp of the series of clamps.

The platform assembly may also include a lower bracket coupled to the one corresponding clamp and configured to be coupled to the one bracket of the plurality of brackets, the lower bracket comprising a plurality of openings configured to align with a plurality of openings in the one bracket and receive a plurality of fasteners to directly couple the one bracket to the one corresponding clamp.

The platform may include a frame, a rail structure extending at least partially around an upper portion of the frame, and a flooring supported by the frame.

The platform assembly may also include an auxiliary device configured to be attached to a plurality of openings in the rail structure.

The auxiliary device may be a protective railing system or a sunshade.

The present disclosure also relates to various embodiments of a sea vessel assembly. In one embodiment, the sea vessel assembly includes a sea vessel having a tower, and a platform assembly coupled to the tower of the sea vessel. The platform assembly includes a platform, a series of brackets coupled to the platform, and a series of clamps coupled to the series of brackets and detachably coupled to the tower of the sea vessel.

The tower may include a fore cross-member and an aft cross-member, the series of clamps may include a first pair of clamps coupled to the fore cross-member and a second pair of clamps coupled to the aft cross-member, and the series of brackets may include a first pair of brackets coupled to the platform and to the first pair of clamps, and a second pair of brackets coupled to the platform and to the second pair of clamps.

The platform assembly may also include a first pair of lower brackets directly coupling the first pair of brackets to the first pair of clamps, and a second pair of lower brackets directly coupling the second pair of brackets to the second pair of clamps.

The tower may include a single cross-member and a series of angled members extending upward from the sea vessel and coupled to the single cross-member. The series of clamps may include a first pair of clamps coupled to the single cross-member and a second pair of clamps coupled to a pair of angled members of the series of angled members, and the series of brackets may include a first pair of brackets coupled to the platform and to the first pair of clamps, and a second pair of brackets coupled to the platform and to the second pair of clamps with a pair of adjustable couplers.

This summary is provided to introduce a selection of concepts that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

The features and advantages of embodiments of the present disclosure will be better understood by reference to the following detailed description when considered in conjunction with the accompanying figures. In the figures, like reference numerals are used throughout the figures to reference like features and components. The figures are not necessarily drawn to scale.

DETAILED DESCRIPTION

The present disclosure relates to various embodiments of a platform configured to be coupled to a tower of a sea vessel (e.g., a recreational boat). The platform is configured to enable storage for boating accessories, such as wakeboards, chairs, ice chests, water skis, towels, umbrellas, innertubes, wake surfboards, and/or rolled up floating units known as "lilly pads." Additionally, the platform of the present disclosure may be utilized by persons to lay or sit on while the sea vessel is not in motion or while the sea vessel is traversing relatively smooth water (e.g., the platform may be utilized as a perch on which individuals can sunbathe). Further, the platform may be utilized as a platform from which individuals can jump into the water. Towers are structures that are attached to recreational use. These towers may be conventionally utilized by wakeboard riders to attach a rope such that they get an upward pull rather than a horizontal pull out of the water while water skiing, wakeboarding, or wake surfing. These towers may also be conventionally utilized to speakers and/or waterboard racks.

Figure 1A:
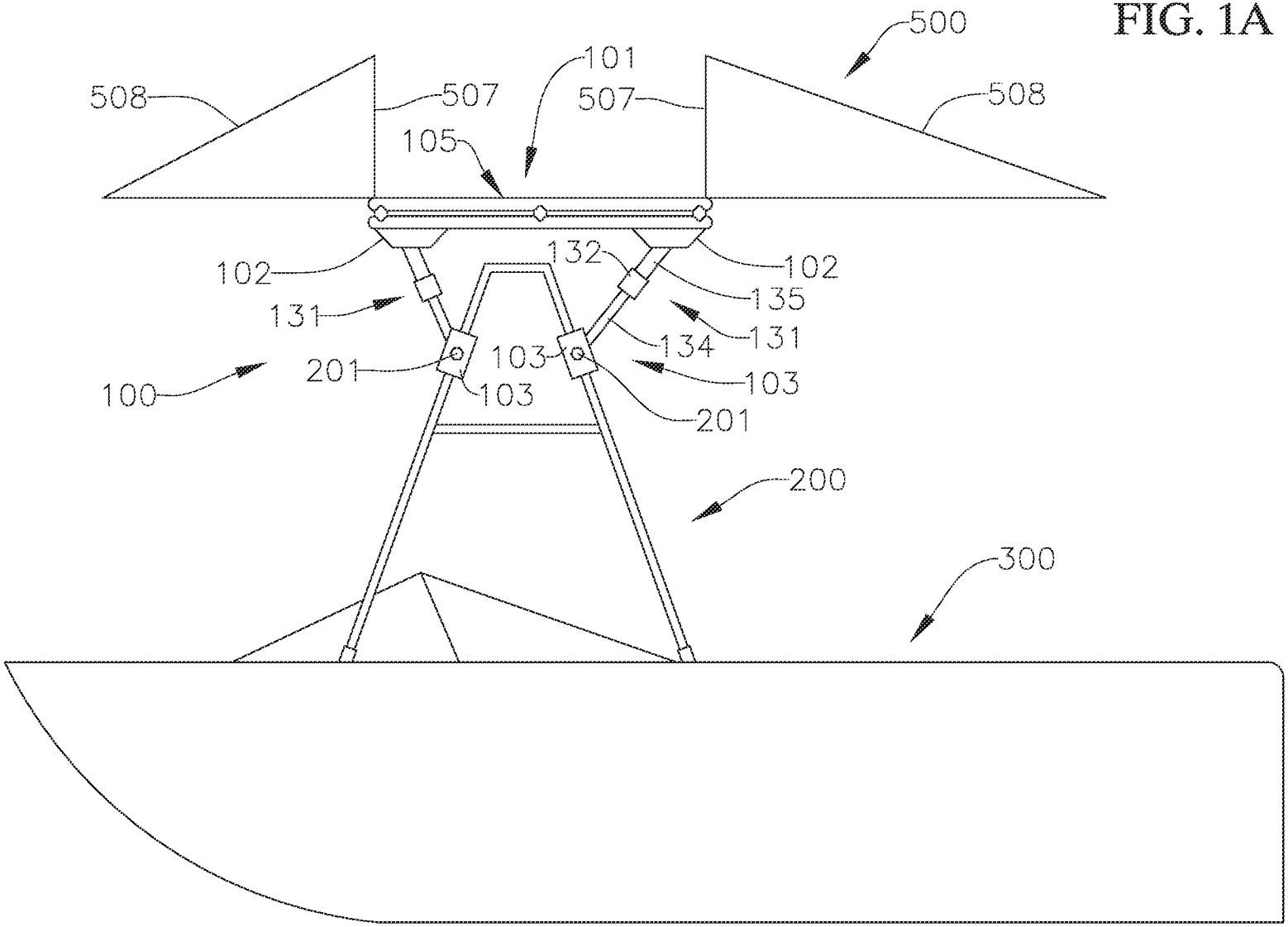
FIG. 1A is a schematic side view of a platform assembly according to one embodiment of the present disclosure coupled to a tower of a vessel, the tower including a pair of cross-members.
Figure 1B:
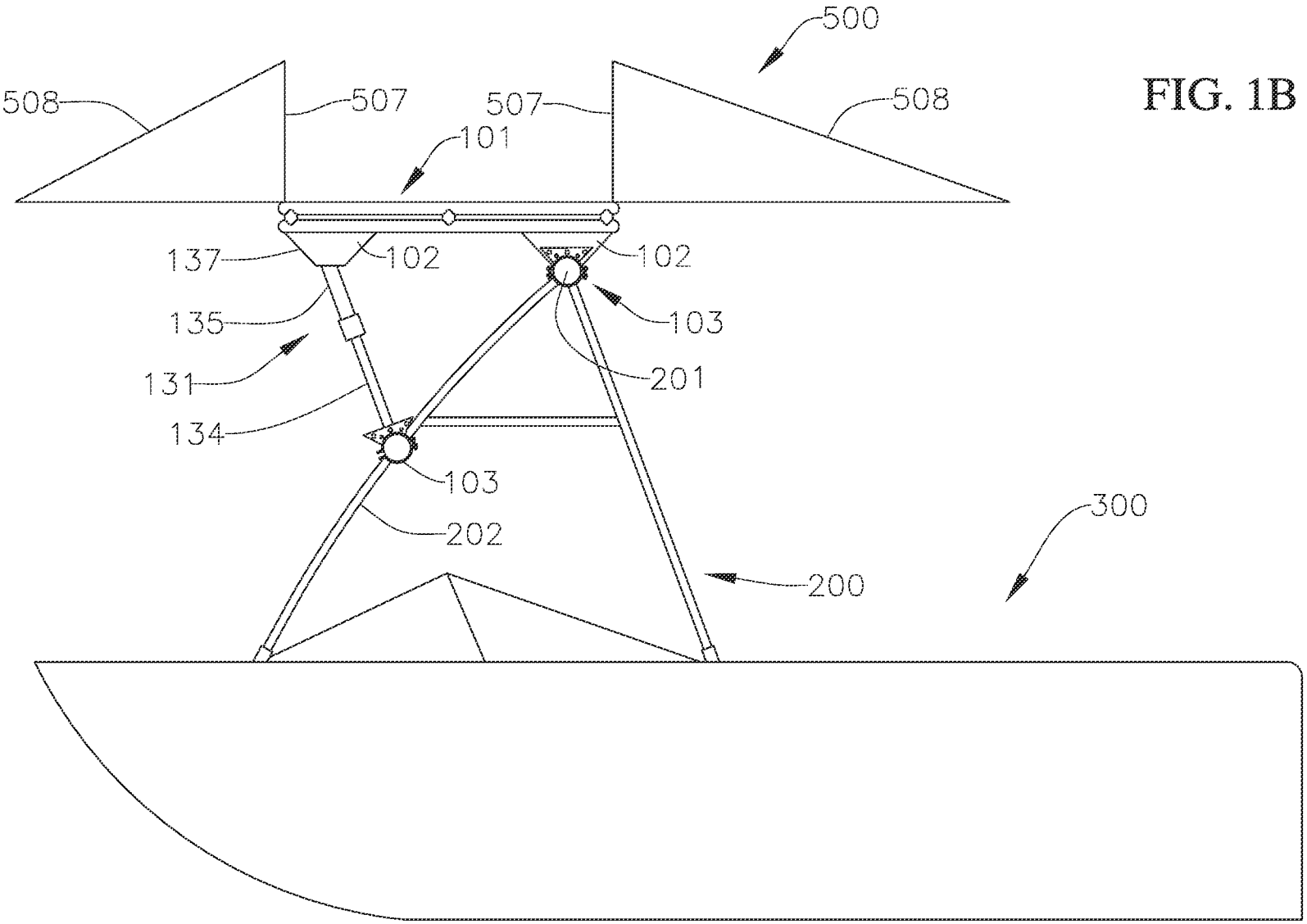
FIG. 1B is a schematic side view of a platform assembly according to another embodiment of the present disclosure coupled to a tower of a vessel, the tower including a single cross-member.

With reference now to FIGS. 1A-1B a platform assembly 100 according to one embodiment of the present disclosure is coupled to a tower 200 of a sea vessel 300. In the illustrated embodiment, the platform assembly 100 includes a platform 101, a series of brackets 102 coupled to the platform 101, and a series of clamps 103 coupled to the brackets 102 and configured to couple the platform assembly 100 to the tower 200 of the boat 300.

Figure 2:
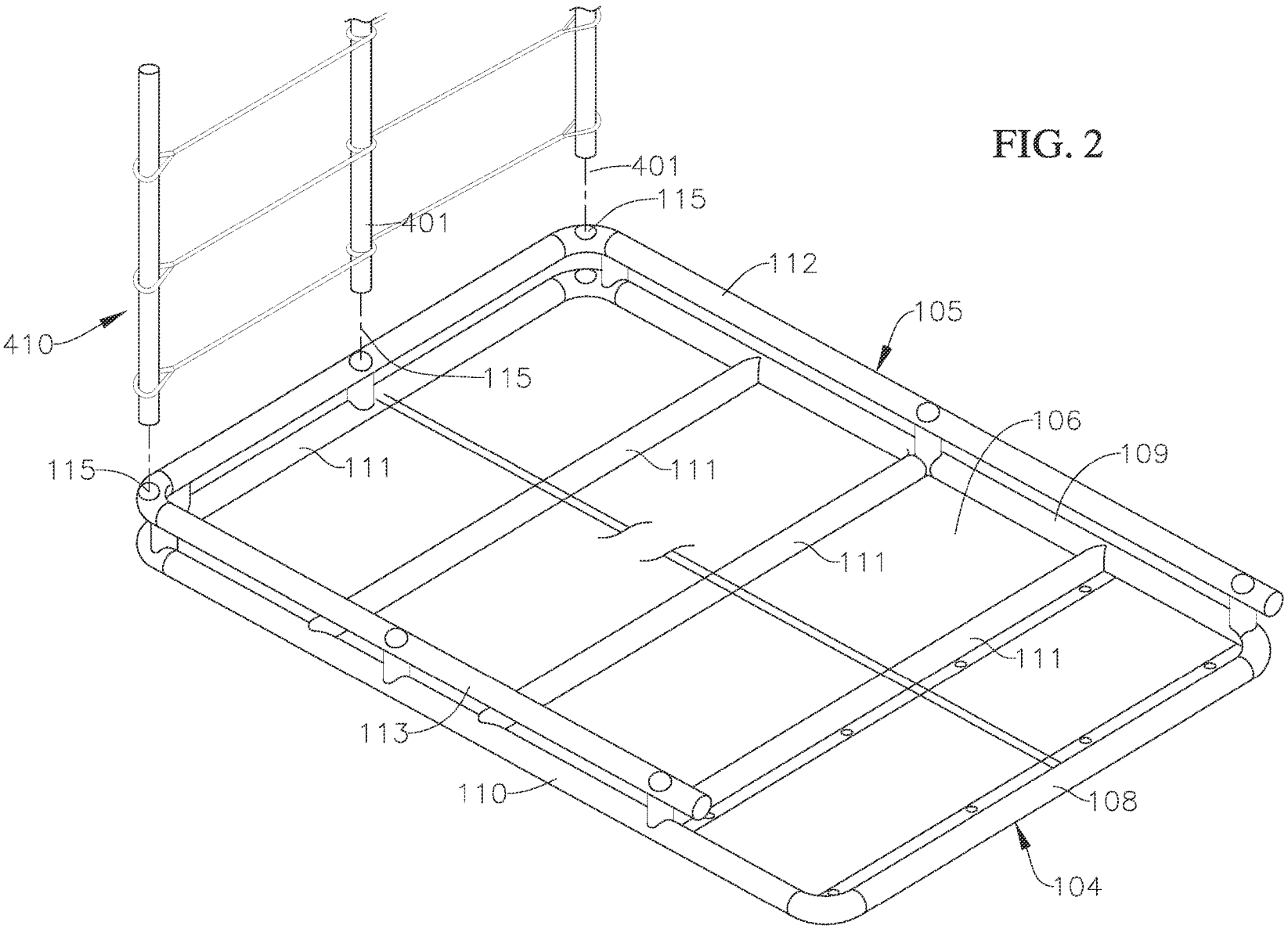
FIG. 2 is a perspective view of a platform according to one embodiment of the present disclosure.

In the embodiment illustrated in FIG. 2, the platform 101 includes a frame 104, a rail structure 105 extending at least partially around an upper portion of the frame 104, and flooring 106 supported by the frame 104. In the illustrated embodiment, the frame 104 includes a pair of opposing longitudinal members 107, 108 and a pair of transverse members 109, 110 connecting opposite ends of the longitudinal members 107, 108. Additionally, in the illustrated embodiment, the frame 104 includes a series of intermediate longitudinal members 111 extending from one transverse member 109 to the other transverse member 110. In the illustrated embodiments, the longitudinal and transverse members 107-110 are arranged in a rectangular configuration, although in one or more embodiments the longitudinal and transverse members 107-110 may be arranged in any other suitable configuration, such as a square configuration.

The rail structure 105 is configured to securely retain items stored on the platform 101 and/or the flooring 106. In the illustrated embodiment, the rail structure 105 extends around three sides of the frame 104, and the rail structure 105 includes a pair of opposing transverse members 112, 113 and a longitudinal member 114 connecting ends of the transverse members 109, 110. Accordingly, in the illustrated embodiment, the rail structure 105 does not extend along one of the longitudinal members 108 of the frame 104. Thus, in the illustrated embodiment, the rail structure 105 is open at one end, which facilitates storing and removing one or more items from the flooring 106 and/or the frame 104.

Figure 3:
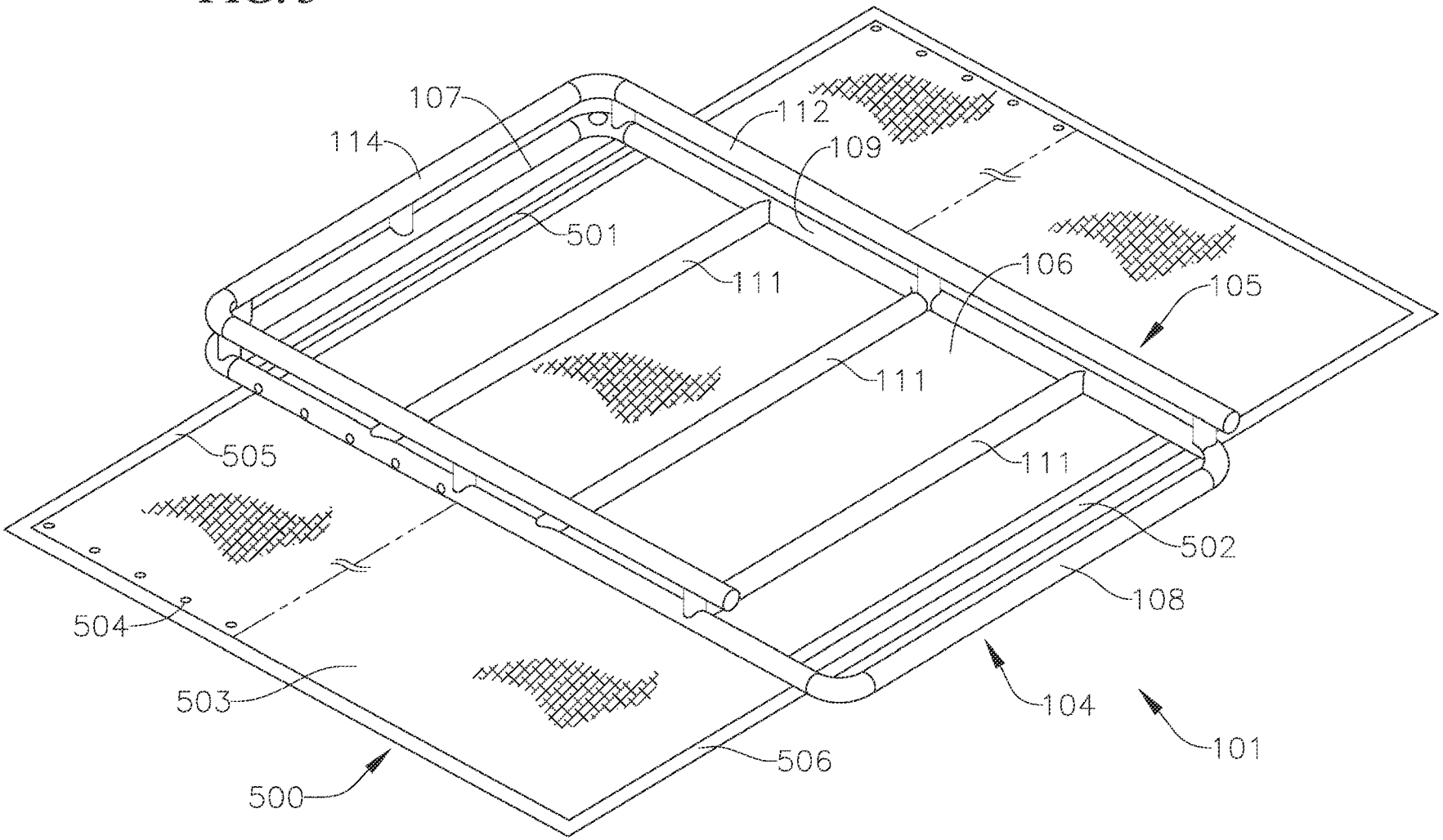
FIG. 3 is a perspective view of a platform according to another embodiment of the present disclosure.
Figure 4A:
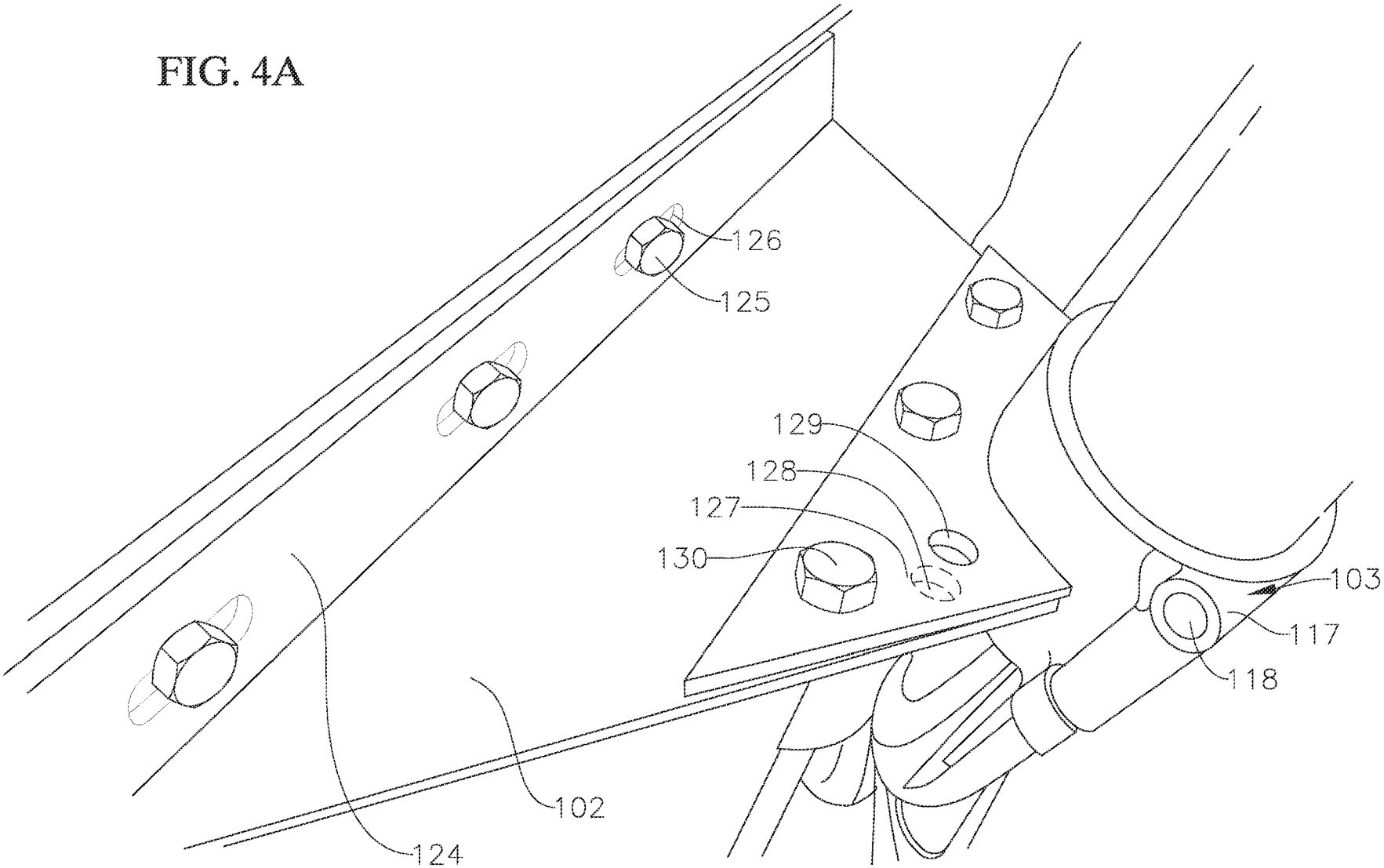
FIGS. 4A-4B are a front perspective view and a rear perspective view, respectively, of a bracket and a clamp according to one embodiment of the present disclosure.
Figure 4B:
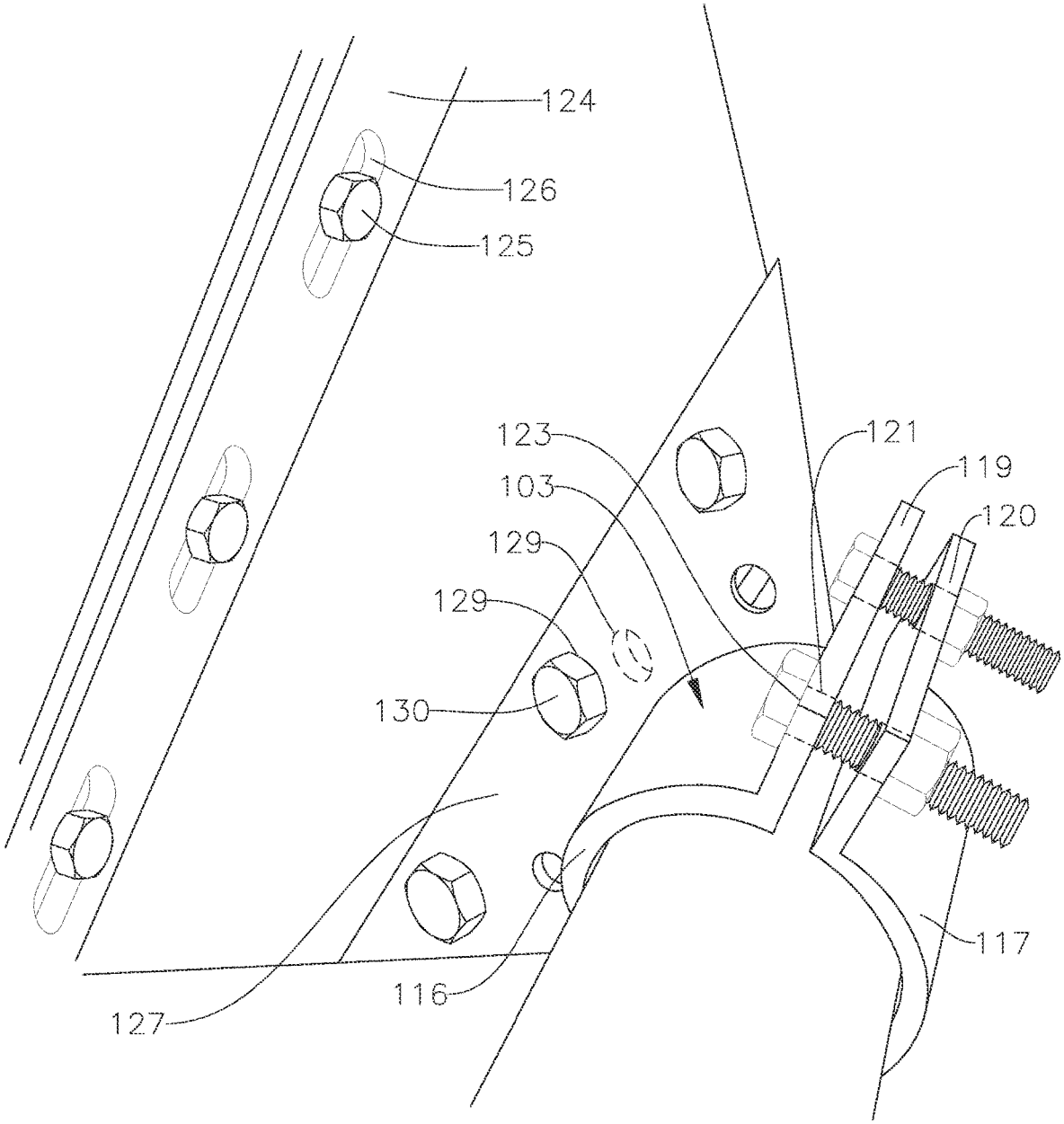
Figure 5:
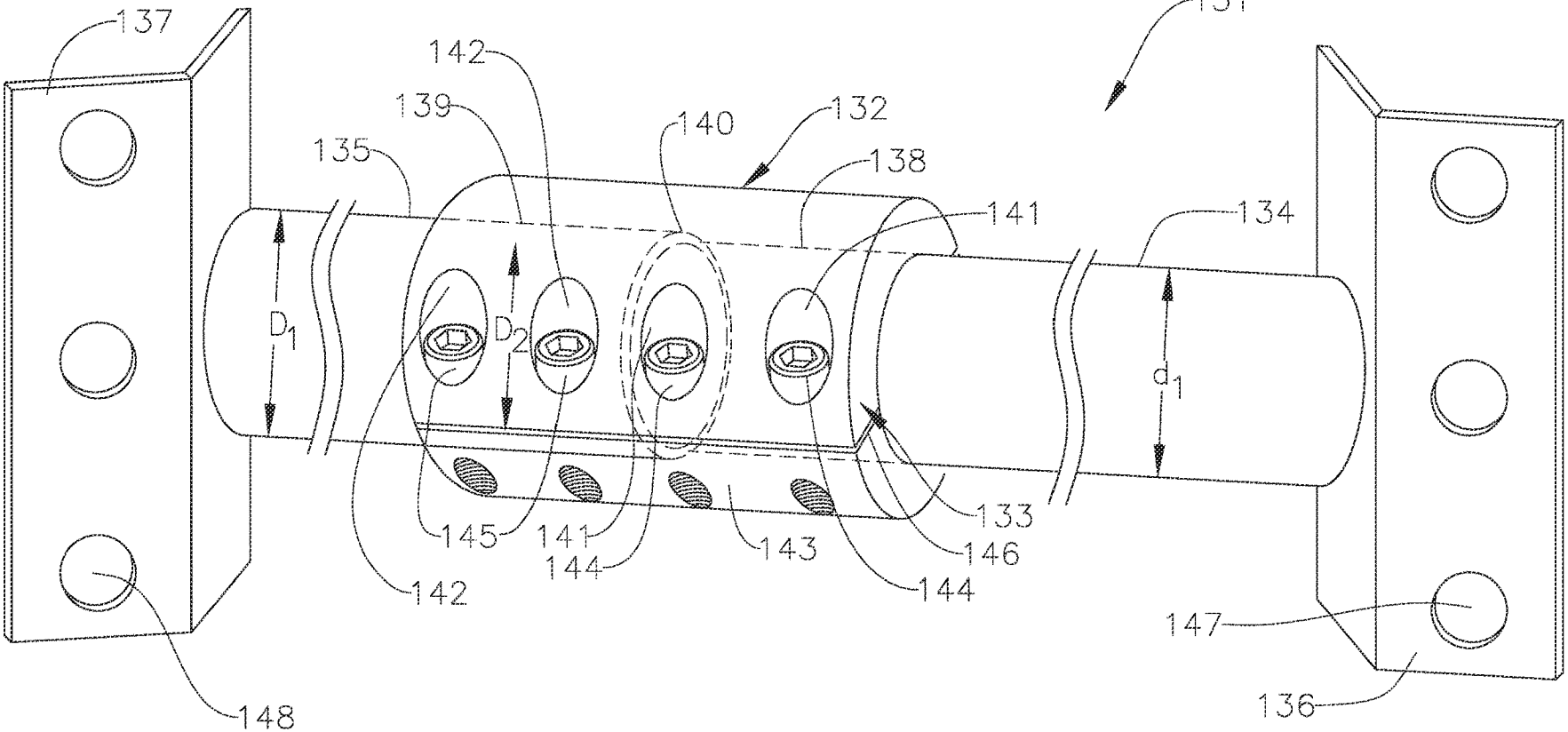
FIG. 5 is a perspective view of an adjustable coupler according to one embodiment of the present disclosure.

Additionally, in the illustrated embodiment, the rail structure 105 includes a series of openings 115 (e.g., holes) configured to enable one or more auxiliary devices to be attached to the platform 101. In one or more embodiments, the auxiliary device may be a protective railing system 400 (shown in FIG. 2) or a sunshade 500 (e.g., forward and reverse sunshades), typically known as "bimini tops" (shown in FIG. 1A). Additionally, the rail structure 105 may be configured to support the sunshade 500 in either a vertical configuration (shown in FIG. 2) or in a horizontal configuration (shown in FIG. 3). As shown in FIG. 3, the rail structure 105 may include a series of tubes 501, 502 that enable the sunshade 500 to slide between a stowed position inside the tubes 501, 502 and a deployed position extending at least partially outside of the tubes 501, 502. The covering 503 (e.g., the marine canvas) of the sunshade 500 may be removed (e.g., by detaching button snaps 504) to enable supports 505, 506 of the sunshade 500 to slide into the stowed position inside the tubes 501, 502.

In the illustrated embodiment, the protective railing system 400 includes a series of vertical posts 401, the lower portions of which are configured to be inserted into the openings 115 of the rail structure 105, and a series of horizontal cables or ropes 402 extending between the vertical posts 401. In one or more embodiments, the horizontal cables or ropes 402 may be a netting extending between the vertical posts 401. The horizontal cables or ropes 402 may be made out of any suitable material(s), such as nylon, fabric, plastic, and/or metal. In one or more embodiments, the vertical posts 401 may be withdrawn from the openings 115 of the rail structure 105 such that the protective railing system 400 may be laid flat and stowed or stored on the frame 104 and/or the flooring 106 when, for example, the sea vessel is in motion.

In the embodiment illustrated in FIG. 1A, the one or more sunshades 500 includes a series of risers 507 (e.g., vertical and/or angled posts), the lower portions of which are configured to be inserted into the openings 115 of the rail structure 105, and a fabric cover 508 connected to upper ends of the risers 501. In one or more embodiments, the risers 507 may be withdrawn from the openings 115 of the rail structure 105 such that the one or more sunshades 500 may be laid flat and stowed or stored on the frame 104 and/or the flooring 106 when, for example, the sea vessel is in motion.

The flooring 106 may be any suitable type or kind of flooring, such as, for example, fabric (e.g., carpet) and/or non-slip foam. In one or more embodiments, the flooring 106 may be formed of any suitable material(s), such as fiberglass, plastic, fabric, and/or natural materials (e.g., wood).

In the illustrated embodiment, each of the clamps 103, which are configured to couple the platform assembly 100 to the tower 200, is a hinged clam-shell including a first clam shell half 116 and a second clam shell half 117 hingedly coupled to the first clam shell half 116 (e.g., with a pin 118). In the illustrated embodiment, the first and second clam shell halves 116, 117 each include a flange 119, 120, respectively, opposite the hinged ends (e.g., the pin 118) of the first and second clam shell halves 116, 117. The first and second clam shell halves 116, 117 are configured to rotate between an open configuration and a closed configuration. In the closed configuration, the flanges 119, 120 of the first and second clam shell halves 116, 117 face each other. In the illustrated embodiment, the flanges 119, 120 of the first and second clam shell halves 116, 117 each include one or more openings 121, 122, respectively. In one or more embodiments, the first and second clam shell halves 116, 117 may be secured together in the closed configuration by one or more fasteners 123 (e.g., one or more bolts) extending through the openings 121, 122 in the flanges 119, 120.

The brackets 102 are coupled (e.g., with fasteners, such as bolts) to the underside of the frame 104. In the illustrated embodiment, the brackets 102 are coupled to the longitudinal members 107, 108 of the frame 104. In the illustrated embodiment, the brackets 102 are riser plates have a generally trapezoidal shape tapering from a relatively wider upper end proximate to the frame 104 to a relatively narrower lower end proximate to the clamps 103. In one or more embodiments, the brackets 102 may have any other suitable shape(s). Additionally, in the illustrated embodiment, each of the brackets 102 also includes a flange 124 along the wider upper end. The flange 124 includes a series of openings 125 configured to receive the fasteners 126 securing the bracket 102 to the frame 104.

Additionally, in the illustrated embodiment, the brackets 102 are coupled to the clamps 103 (which couples the brackets 102 to the tower 200) with lower brackets 127. In the illustrated embodiment, the lower brackets 127 are half-moon shaped, although in one or more embodiments, the lower brackets 127 may have any other suitable shape. Additionally, the height and angle of the lower brackets 127 may vary depending, for instance, on the model of the boat 300 and/or the configuration of the tower 200. Additionally, in the illustrated embodiment, the lower bracket 127 defines a series of openings 128 (e.g., mounting holes) configured to align with openings 129 in a lower end of the bracket 102. The aligned openings 128, 129 in the bracket 102 and the lower bracket 127 are configured to receive fasteners 130 securing the bracket 102 to the lower bracket 127. The lower bracket 127 may be coupled to the first clam shell half 116 of the clamp 103 in any suitable manner (e.g., the lower bracket 127 may be welded to or integrally formed with the first clam shell half 116).

As illustrated in FIG. 1A, if the tower 200 includes a pair of fore and aft cross-members 201 (e.g., front and rear crossbars), the platform assembly 100 may include two pairs of the brackets 102 coupled to the cross-members 201 with two pairs of clamps 103 and two pairs of lower brackets 127 (e.g., the platform assembly 100 may include a pair of brackets 102 and a pair of lower brackets 127 coupled to the fore cross-member 201 of the tower 200 with a pair of clamps 103, and a pair of brackets 102 and a pair of lower brackets 127 coupled to the aft cross-member 201 of the tower 200 with a pair of clamps 103). The two pairs of brackets 102 and the corresponding two pairs of lower brackets 127 coupled to the pair of fore and aft cross-members 201 of the tower 200 provide stability and prevent the platform assembly 100 from rotating relative to the tower 200.

However, if the tower 200 includes only a single cross-member 201, a pair of brackets 102 coupled to the single cross-member 201 of the tower 200 may provide insufficient stability for the platform assembly 100 (e.g., the platform assembly 100 may tend to rotate upward and/or downward relative to the tower 200). Accordingly, in one or more embodiments, the platform assembly 100 may include one or more adjustable couplers 131. For instance, as illustrated in FIG. 1B, if the tower 200 includes only a single cross-member 201, the platform assembly 100 may include a pair of brackets 102 and a corresponding pair of lower brackets 127 coupled to the single cross-member 201 of the tower 200 with a pair of clamps 103, and the platform assembly 100 may include also include a pair of adjustable couplers 127 coupled to two angled members 202 (e.g., slanted or diagonal members) of the tower 200.

In the illustrated embodiment, each of the adjustable couplers 131 includes a main body portion 132 defining a central opening 133, an outer tube 134 having a relatively larger outer diameter d1, an inner tube 135 having a relatively smaller outer diameter d2, a first fixture 136 coupled to an end of the outer tube 134, and a second fixture 137 coupled to an end of the inner tube 135. In the illustrated embodiment, the central opening 133 defined by the main body portion 132 is stepped (e.g., the central opening 133 has a portion 138 with a relatively larger diameter D1, a portion 139 with a relatively smaller diameter D2, and a step or shoulder 140 between the portion 134 with the relatively larger diameter D1 and the portion 139 with the relatively smaller diameter D2). In the illustrated embodiment, the position of outer tube 134 is fixed relative to the main body portion 132 (e.g., the outer tube 134 extends into the portion 138 of the central opening 133 with the larger diameter D1 and an end of the outer tube 134 abuts the shoulder 140). In the illustrated embodiment, the inner tube 135 is slidable within the outer tube 134 and the main body portion 132 (e.g., the portion 139 of the central opening 133 having the relatively smaller diameter D2).

Additionally, in the illustrated embodiment, the main body portion 132 defines a slit or a slot 146 extending along an entire length of the main body portion 132. The main body portion 132 also includes a series of openings 141, 142 that extend inward from an outer surface 143 of the main body portion 132 and across the slot 146. The series of openings 141, 142 accommodate a series of set screws 144, 145, respectively. In the illustrated embodiment, the adjustable coupler 131 includes two openings 141 positioned along the portion of the main body portion 132 that defines the portion 138 of the central opening 133 having the relatively larger diameter D1 and two corresponding set screws 144, and two openings 142 positioned along the portion of the main body portion 132 that defines the portion 139 of the central opening 133 having the relatively smaller diameter D2 and two corresponding set screws 145. When the set screws 144, 145 are tightened, the slot 146 closes or at least reduces in width such that the main body portion 132 engages (e.g., clamps) the outer tube 134 and the inner tube 135 and thereby fixes the position of the outer tube 134 and the inner tube 135 relative to the main body portion 132

(e.g., tightening the set screws 144 is configured to reduce the diameter of the portion 138 of the central opening 133 having the relatively larger diameter D1 such that the main body portion clamps onto the outer tube 134, and tightening the set screws 145 is configured to reduce the diameter of the portion 139 of the central opening 133 having the relatively smaller diameter D2 such that the main body portion clamps onto the inner tube 135). In one or more embodiments, the set screws 144, 145 may directly engage the outer tube 134 and the inner tube 135, respectively, to fix the position of the inner tube 134 and the outer tube 135 relative to the main body portion 132.

In use, to adjust the length of the adjustable coupler 131, the inner tube 135 may be slid relative to the outer tube 134 and the main body portion 132 and then the set screws 145 may be screwed in to fix the position of the inner tube 135 relative to the outer tube 134 and the main body portion 132. In this manner, the length of the adjustable coupler 131 is adjustable such that the adjustable coupler 131 may be utilized to couple the platform assembly 100 to a variety of different configurations of the tower 200 (e.g., the adjustable coupler 131 is "universal").

In the illustrated embodiment, the first fixture 136, which is coupled to the end of the outer tube 134, is configured to be coupled to one of the angled members 202 of the tower 200 with a clamp (e.g., the hinged clam-shell 103 described above). In the illustrated embodiment, the first fixture 136 includes a series of openings 147 (e.g., holes) configured to align with the openings 129 in the lower bracket 127 to receive fasteners securing the first fixture 136 to the lower bracket 127. The second fixture 137, which is coupled to the end of the inner tube 135, is configured to be coupled to the frame 104 (e.g., longitudinal members 107, 108) of the platform 101 (e.g., the bracket 102 described above). In the illustrated embodiment, the second fixture 137 includes a series of openings 148 (e.g., holes) configured to align with the openings 128 in the bracket 102 to receive fasteners securing the second fixture 137 to the bracket 102. The first and second fixtures 136, 137 may have any suitable configuration, such as, for instance, a flat plate, an L-bracket, a U-shaped bracket, or a bar.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention. Although relative terms such as "outer," "inner," "upper," "lower," and similar terms have been used herein to describe a spatial relationship of one element to another, it is understood that these terms are intended to encompass different orientations of the various elements and components of the invention in addition to the orientation depicted in the figures. Additionally, as used herein, the term "substantially," "about," and similar terms are used as terms of approximation and not as terms of degree, and are intended to account for the inherent deviations in measured or calculated values that would be recognized by those of ordinary skill in the art. Furthermore, as used herein, when a component is component is referred to as being "coupled" to another component, it can be directly attached to the other component or intervening components may be present therebetween.

What is claimed is:

1. A platform assembly configured to be coupled to a tower of a sea vessel, the platform assembly comprising:
- a platform;
- a plurality of brackets configured to be coupled to the platform;
- a plurality of clamps configured to be coupled to the plurality of brackets, wherein the plurality of clamps are configured to detachably couple the platform assembly to the tower of the sea vessel; and
- an adjustable coupler configured to couple one bracket of the plurality of brackets to one corresponding clamp of the plurality of clamps, wherein the adjustable coupler comprises:
  - a main body portion defining a central opening;
  - an outer tube having a first diameter extending into the central opening;
  - an inner tube having a second diameter less than the first diameter extending into the central opening;
  - a first fixture coupled to an end portion of the outer tube; and
  - a second fixture coupled to an end portion of the inner tube,
  - wherein the inner tube is slidable within the central opening of the main body portion and within the outer tube to adjust an overall length of the adjustable coupler.

2. The platform assembly of claim 1, wherein at least one clamp of the plurality of clamps is hinged clam-shell clamp comprising a first clam shell half and a second clam shell half hingedly coupled to the first clam shell half with a pin.

3. The platform assembly of claim 2, wherein at least one bracket of the plurality of brackets comprises a riser plate and a flange coupled to the riser plate, the flange defining at least one opening configured to receive a fastener securing the at least one bracket to the platform.

4. The platform assembly of claim 3, wherein the riser plate tapers from a relatively wider upper end to a relatively narrower lower end.

5. The platform assembly of claim 1, wherein the central opening of the main body portion comprises:
- a first portion;
- a second portion having a larger diameter than the first portion; and
- a shoulder between the first portion and the second portion.

6. The platform assembly of claim 5, wherein the main body portion comprises:
- a first opening extending into the first portion of the central opening;
- a first set screw in the first opening, the first set screw extending into the first portion of the central opening and configured to engage the inner tube;
- a second opening extending into the second portion of the central opening; and
- a second set screw in the second opening, the second set screw extending into the second portion of the central opening and configured to engage the outer tube.

7. The platform assembly of claim 1, wherein one bracket of the plurality of brackets is configured to be directly coupled to one corresponding clamp of the plurality of clamps.

8. The platform assembly of claim 7, further comprising a lower bracket coupled to the one corresponding clamp and configured to be coupled to the one bracket of the plurality of brackets, the lower bracket comprising a plurality of openings configured to align with a plurality of openings in the one bracket and receive a plurality of fasteners to directly couple the one bracket to the one corresponding clamp.

9. The platform assembly of claim 1, wherein the platform comprises:

frame; and a rail structure extending at least partially around an upper portion of the frame; and a flooring supported by the frame.

10. The platform assembly of claim 9, further comprising an auxiliary device configured to be attached to a plurality of openings in the rail structure.

11. The platform assembly of claim 10, wherein the auxiliary device is a protective railing system.

12. The platform assembly of claim 10, wherein the auxiliary device is a sunshade.

13. A sea vessel assembly comprising:

a sea vessel comprising a tower; and a platform assembly coupled to the tower of the sea vessel, the platform assembly comprising:

a platform;

a plurality of brackets coupled to the platform; and a plurality of clamps coupled to the plurality of brackets and detachably coupled to the tower of the sea vessel; and an adjustable coupler configured to couple one bracket of the plurality of brackets to one corresponding clamp of the plurality of clamps, wherein the adjustable coupler comprises:

a main body portion defining a central opening;

an outer tube having a first diameter extending into the central opening;

an inner tube having a second diameter less than the first diameter extending into the central opening;

a first fixture coupled to an end portion of the outer tube; and a second fixture coupled to an end portion of the inner tube, wherein the inner tube is slidable within the central opening of the main body portion and within the outer tube to adjust an overall length of the adjustable coupler.

14. The sea vessel of claim 13, wherein:

the tower comprises a fore cross-member and an aft cross-member, the plurality of clamps comprises a first pair of clamps coupled to the fore cross-member and a second pair of clamps coupled to the aft cross-member, and the plurality of brackets comprises a first pair of brackets coupled to the platform and to the first pair of clamps, and a second pair of brackets coupled to the platform and to the second pair of clamps.

15. The sea vessel of claim 14, wherein the platform assembly further comprises a first pair of lower brackets directly coupling the first pair of brackets to the first pair of clamps, and a second pair of lower brackets directly coupling the second pair of brackets to the second pair of clamps.

16. The sea vessel of claim 13, wherein:

the tower comprises a single cross-member and a plurality of angled members extending upward from the sea vessel and coupled to the single cross-member, the plurality of clamps comprises a first pair of clamps coupled to the single cross-member and a second pair of clamps coupled to a pair of angled members of the plurality of angled members, and the plurality of brackets comprises a first pair of brackets coupled to the platform and to the first pair of clamps, and a second pair of brackets coupled to the platform and to the second pair of clamps with a pair of adjustable couplers.

* * * * *